US006183153B1

(12) United States Patent
Kamoda et al.

(10) Patent No.: US 6,183,153 B1
(45) Date of Patent: Feb. 6, 2001

(54) HOLDER FOR ROLL-TYPE PRINT MEDIA, ROLL-TYPE PRINT MEDIA CASSETTE, AND PRINTING APPARATUS

(75) Inventors: Hitoshi Kamoda, Kanagawa; Shinichi Kondo, Miyagi; Yoshihiro Okamoto, Kanagawa; Nobuyuki Kamitani, Kanagawa; Morihiro Deura, Kanagawa, all of (JP)

(73) Assignee: Sony Corporation, Tokyo (JP)

( * ) Notice: Under 35 U.S.C. 154(b), the term of this patent shall be extended for 0 days.

(21) Appl. No.: 09/300,034

(22) Filed: Apr. 27, 1999

(30) Foreign Application Priority Data

Apr. 30, 1998 (JP) ..... 10-121537
Apr. 30, 1998 (JP) ..... 10-121538

(51) Int. Cl.[7] ..... B41J 11/26

(52) U.S. Cl. ..... 400/613; 400/242; 400/236.1; 400/207; 400/208.1; 400/208

(58) Field of Search ..... 400/613, 196, 400/202.1, 207, 208, 208.1, 220, 220.1, 220.2, 221, 236.1, 242, 247, 249

(56) References Cited

U.S. PATENT DOCUMENTS 3,216,021 * 11/1965 Stefansson ..... 346/136
4,367,666 * 1/1983 Toth ..... 83/203
4,904,100 * 2/1990 Enix ..... 400/613
5,230,576 * 7/1993 Sone ..... 400/613 X
5,269,612 * 12/1993 Shimoha et al. ..... 400/207
5,271,576 * 12/1993 Kataoka ..... 242/71.1
5,908,171 * 1/1999 Raudaskoski ..... 242/530.1

FOREIGN PATENT DOCUMENTS 682656 10/1993 (CH) .
0505943 A1 * 9/1992 (EP) ..... B41J/15/04
0681212 A2 * 8/1995 (EP) ..... G03C/3/00
872353 10/1998 (EP) .
60-118556 6/1985 (JP) .

OTHER PUBLICATIONS

European Search Report dated Nov. 25, 1999, for EP Application No. 99.108.423.7–1251.

* cited by examiner

*Primary Examiner*—John S. Hilten
*Assistant Examiner*—Minh H. Chau
(74) *Attorney, Agent, or Firm*—Philip M. Shaw, Jr.; John W. Carpenter; Crosby, Heafey, Roach & May

(57) ABSTRACT

A holder for roll-type print media and a roll-type print media cassette, for easing replacement of a roll, including a printing apparatus capable of detecting the presence of a roll-type print media. The holder and cassette include supporting means for supporting the roll-type print media rotatively and regulating means for regulating the unwinding of the print media. The printing apparatus includes print media supporting means for supporting the roll-type print media rotatively such that the position of the axis of rotation is fixed. A contact sensor for detecting the presence of roll-type print media is also provided.

11 Claims, 10 Drawing Sheets

HOLDER FOR ROLL-TYPE PRINT MEDIA, ROLL-TYPE PRINT MEDIA CASSETTE, AND PRINTING APPARATUS

BACKGROUND OF THE INVENTION

1. Field of the Invention

The present invention relates generally to the field of holders for roll type print media, roll type print media cassettes, and related printing devices, and more particularly to a system for printing on a thermal print film wound in a roll shape.

2. Description of the Background Art

Conventional print media, such as printing paper and thermal print film, are often wound in the shape of a roll (hereinafter, referred to as roll-type print media). Various printing apparatuses corresponding to the roll type print media have been also manufactured. The printing apparatus has the advantage of being miniaturized entirely, since the space to load a print media (hereinafter, referred to as loading space) is small in comparison to other printing apparatuses using paper stock or print film cut into a predetermined size (e.g., A4 size). The roll-type printing apparatus also has the advantage of loading a large quantity of print media in a small loading space.

Among available roll-type print media, print film wound in the shape of a roll can be problematic in that it may easily become unwound due to the very low coefficient of friction and adhesion between adjacent surfaces on the roll. For this reason, roll-type print media can be difficult to load in a printing apparatus in such a manner that the print film does not become unwound. This problem is especially acute where roll-type print media is replaced frequently, and work efficiency for replacement is concomitantly decreased. This problem can also be especially severe where transparent print media (as for printing x-ray images) is installed, since conventional printing apparatuses requiring roll-type print media normally detect the existence of an installed roll using a light sensor, and transparent film partially unwound can go undetected when a light beam emitted from the optical sensor penetrates the transparent print layers film without detection.

One available approach to solving the above-described problem comprises a method of detecting the existence of roll type print media using a contact sensor within the printing apparatus. However, the roll-type print media is unstable in that it rolls within the loading space and changes in diameter throughout the period of its consumption. Thus, even if a contact sensor is used to detect the existence of the roll-type print media in the conventional printing apparatus, it is difficult to place the contact sensor into reliable contact with the roll type print media. As a result, efficiently and reliably detecting the existence of roll-type print media remains a challenge.

SUMMARY OF THE INVENTION

In view of the foregoing, an advantage of the present invention is the provision of a holder for roll-type print media and a roll-type print media cassette which reliably detects the existence of, and simplifies replacement procedures for, roll-type print media.

The foregoing advantage and other advantages of the invention have been achieved by the provision of a holder for roll-type print media comprising supporting means for rotatively supporting the roll-type print media and a wind regulator for preventing roll-type print media from coming unwound. As a result, the present holder for roll-type print media makes it possible to prevent the roll-type print media from being unwound and to handle the roll-type print media easily.

The invention further provides a roll-type print media cassette comprising a roll-type print media, supporting means for rotatively supporting the roll-type print media, and regulating means for preventing the roll-type print media from coming unwound. As a result, this roll-type print media cassette makes it possible to prevent the roll-type print media from being unwound and to handle the roll-type print media easily.

The invention still further provides a printing apparatus comprising print media supporting means for rotatively supporting the roll-type print media at a predetermined position and a contact sensor for detecting the existence of the roll-type print media within the printing apparatus. As a result, the present printing apparatus maintains the roll-type print media in contact with a sensor, by maintaining the stability of the position of the roll-type print media within the printing apparatus.

The nature, principle and utility of the invention will become more apparent from the following detailed description when read in conjunction with the accompanying drawings in which like parts are designated by like reference numerals or characters.

BRIEF DESCRIPTION OF THE DRAWINGS

The aforementioned advantages of the present invention as well as additional advantages thereof will be more clearly understood hereinafter as a result of a detailed description of a preferred embodiment of the invention when taken in conjunction with the following drawings.

Figure 1:
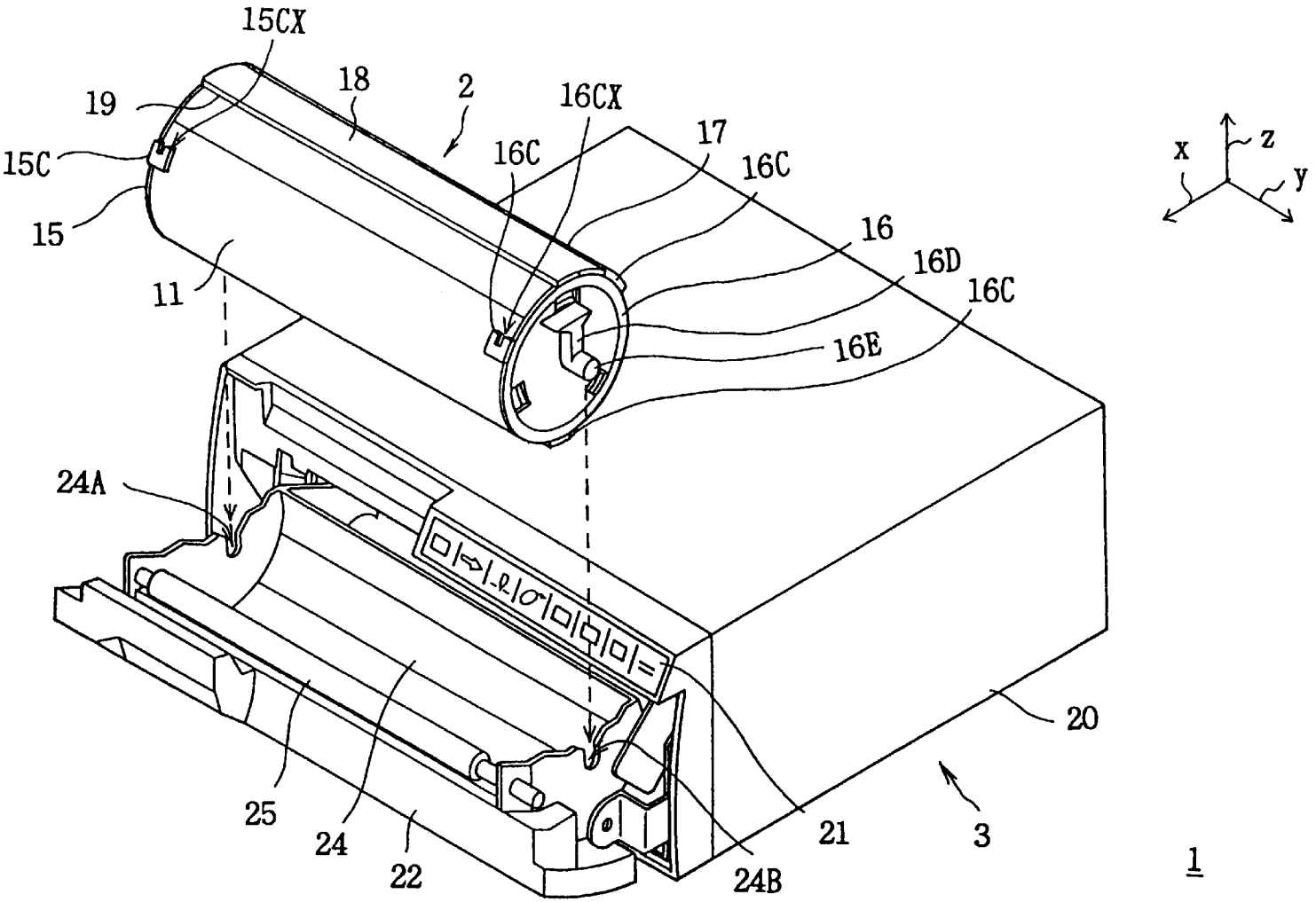
FIG. 1 is a perspective view illustrating the configuration of a printing apparatus according to this embodiment.

While the invention is susceptible to various modifications and alternative forms, specific embodiments thereof have been shown by way of example in the drawings and will herein be described in detail. It should be understood, however, that the detailed description is not intended to limit the invention to the particular forms disclosed. On the contrary, the intention is to cover all modifications, equivalents, and alternatives falling within the spirit and scope of the invention as defined by the appended claims.

DETAILED DESCRIPTION OF PREFERRED EMBODIMENTS (1) A Printing System According to a First Embodiment Referring first to FIG. 1, a printing system 1 is composed of a print film cassette 2 and a printing apparatus 3. The print film cassette 2, also illustrated in FIG. 2, includes a print film part 11, comprising a print film 9 wound around a cylindrical roll core 10. Print film part 11 is rotatively supported by a holder 12. The holder 12 is actually composed of first and second sleeves 13, 14 and first and second disc-type supporting members 15, 16. Sleeves 13, 14 respectively include cylindrical parts 13A, 14A, both having the outside diameter being approximately equivalent to the inside diameter of the roll core 10. First and second disc type supporting members 15, 16 both have an outside diameter being approximately equivalent to the maximum diameter of the print film part 11. The first and second sleeves 13, 14 are respectively fixed to the print film part 11 in such a way that the cylindrical parts 13A, 14A are respectively fitted in one end or the other end of the roll core 10.

Figure 3:
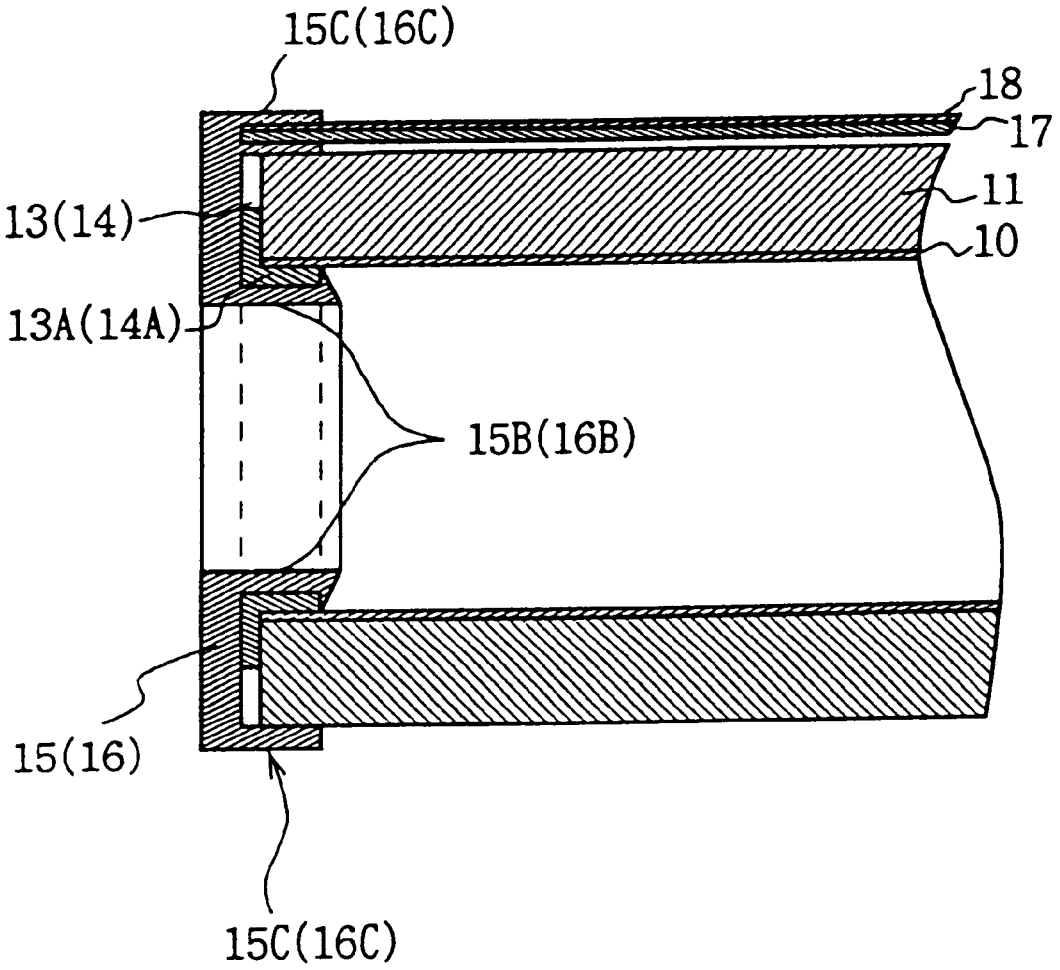
FIG. 3 is a cross-sectional view explaining the support of a print film portion by the holder.

In the inner sides 15A, 16A of the first and second supporting members 15, 16, a plurality of arc-type fitting projections 15B, 16B having the outside diameter being approximately equivalent to the inside diameter of the first and second sleeves 13, 14 are provided at equivalent internals. As shown in FIG. 3, fitting projections 15B, 16B of the first and second supporting members 15, 16 are fitted in the corresponding cylindrical parts 13A, 14A of the first and second sleeves 13, 14. Thus, in the print film cassette 2, the print film part 11 can be rotated integrally with the first and second sleeves 13, 14 and the roll core 10, so as to pull out the print film 9 of print film part 11 easily.

In holder 12, the first and second supporting members 15, 16 and the first and second sleeves 13, 14 are formed out of materials having a small friction coefficient such as plastics, so as to reduce the friction between the first and second sleeves 13, 14 and the corresponding first and second supporting members 15, 16 when the print film part 11 rotates, thereby avoiding generation of fine particles which might otherwise result from frictional movement.

On the outer sides of the first and second supporting members 15, 16, arc type pawls 15C, 16C are provided at at least three points, projecting into the center of the holder 12 and facing each other. The print film cassette 2 regulates the maximum diameter of the print film 9 of the print film part 11 by these pawls 15C, 16C, so as to prevent the print film 9 from being unwound to occupy a diameter greater than the outside diameter of the first and second supporting members 15 and 16.

Figure 4:
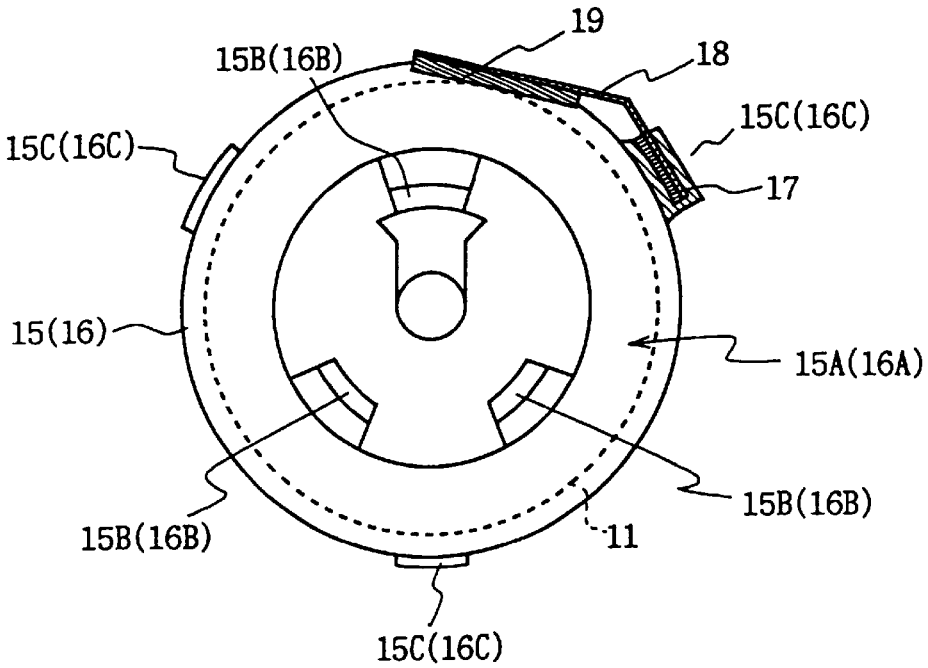
FIG. 4 is a cross-sectional view explaining the partial constitution of the holder.
Figure 5:
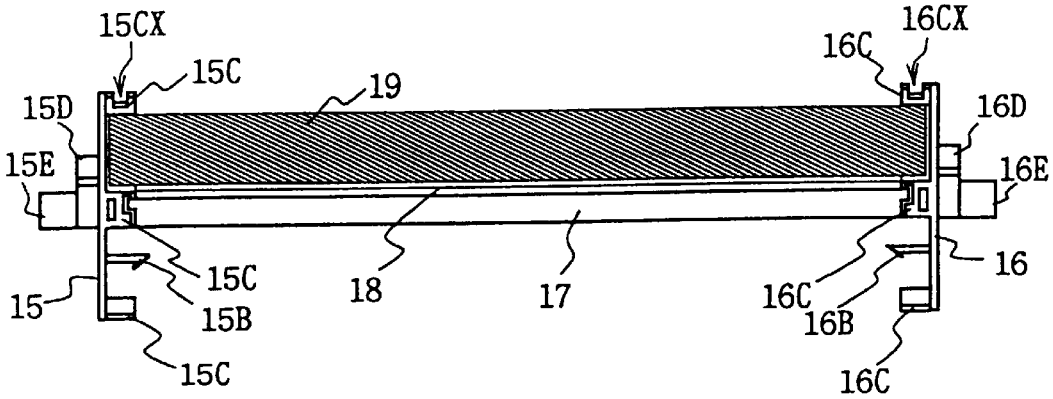
FIG. 5 is a top plan view explaining the partial constitution of the holder.
Figure 6:
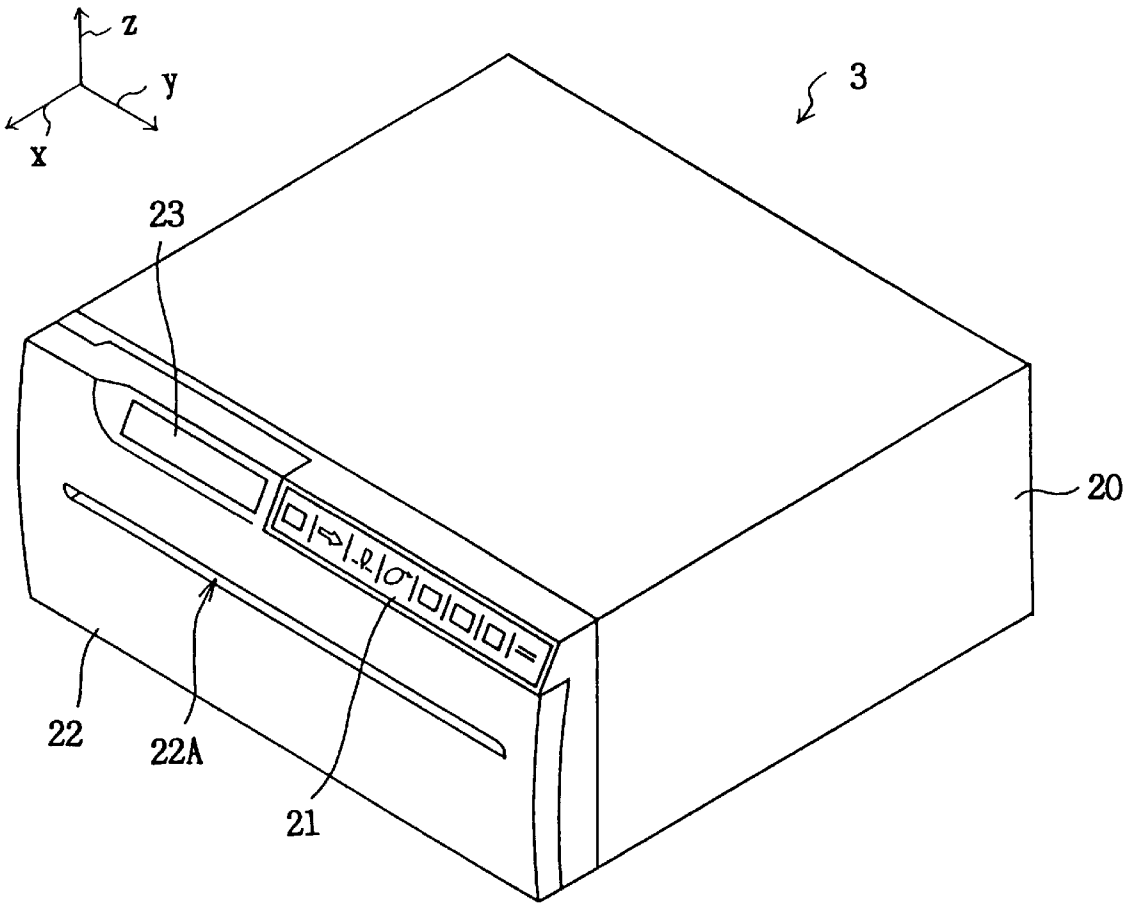
FIG. 6 is a perspective view illustrating the outward constitution of the printing apparatus.

Further, as shown in FIG. 4 and FIG. 5, a spoke 17 spans between the specific pawls 15C, 16C of the first and second supporting members 15, 16 to integratedly couple the first supporting member 15 and the second supporting member 16 while maintaining a predetermined intervening distance. A dust pad 19 being a sponge having the approximately same length as the width of the print film part 11 is provided in the spoke 17, and bound to a film 18. Film 18 is bent toward the interior of the first and second supporting members 15, 16 at the end portion where the dust pad 19 is provided, thereby pressing the dust pad 19 on the surface of the print film 9 of the print film part 11 in a manner supported by the elasticity of the film 18. Thus, in the print film cassette 2, when the print film 9 of the print film part 11 is pulled out, the dust pad 19 is rubbed on the surface of the print film 9 so that the dust attached on the surface of the print film 9 is wiped and removed by the dust pad 19.

Turning next to FIG. 3, printing apparatus 3 includes a door part 22, which is freely opened and shut, and is provided on the front of a housing 20, avoiding contact with an operation panel 21. A liquid crystal display panel 23 and a paper discharge port 22A are provided on the front of the door part 22, and as shown in FIG. 1, a paper tray 24 and a platen 25 supported rotatively are disposed inside printing apparatus 3, behind door part 22.

Figure 2:
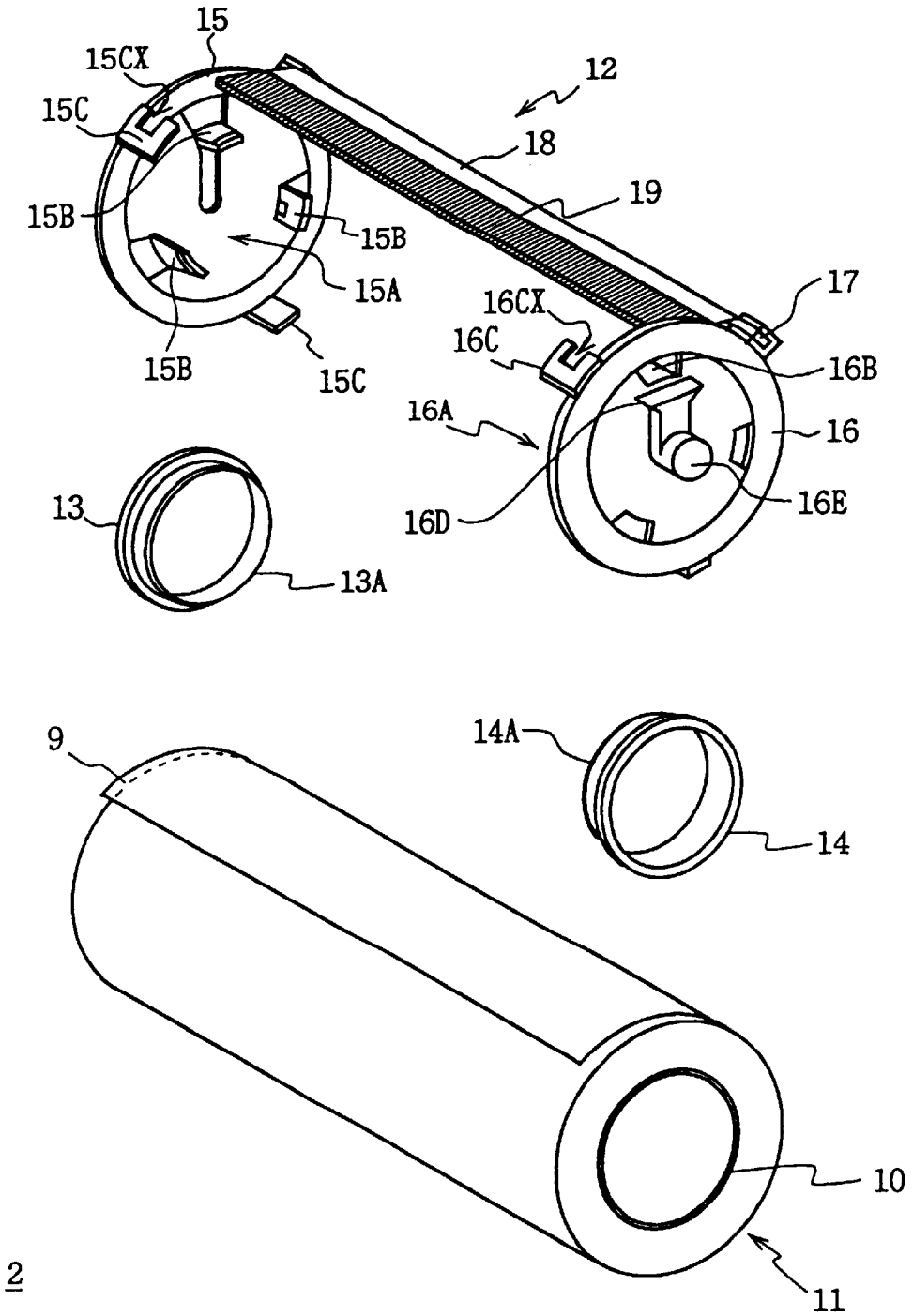
FIG. 2 is an exploded perspective view illustrating the configuration of a film cassette.
Figure 7:
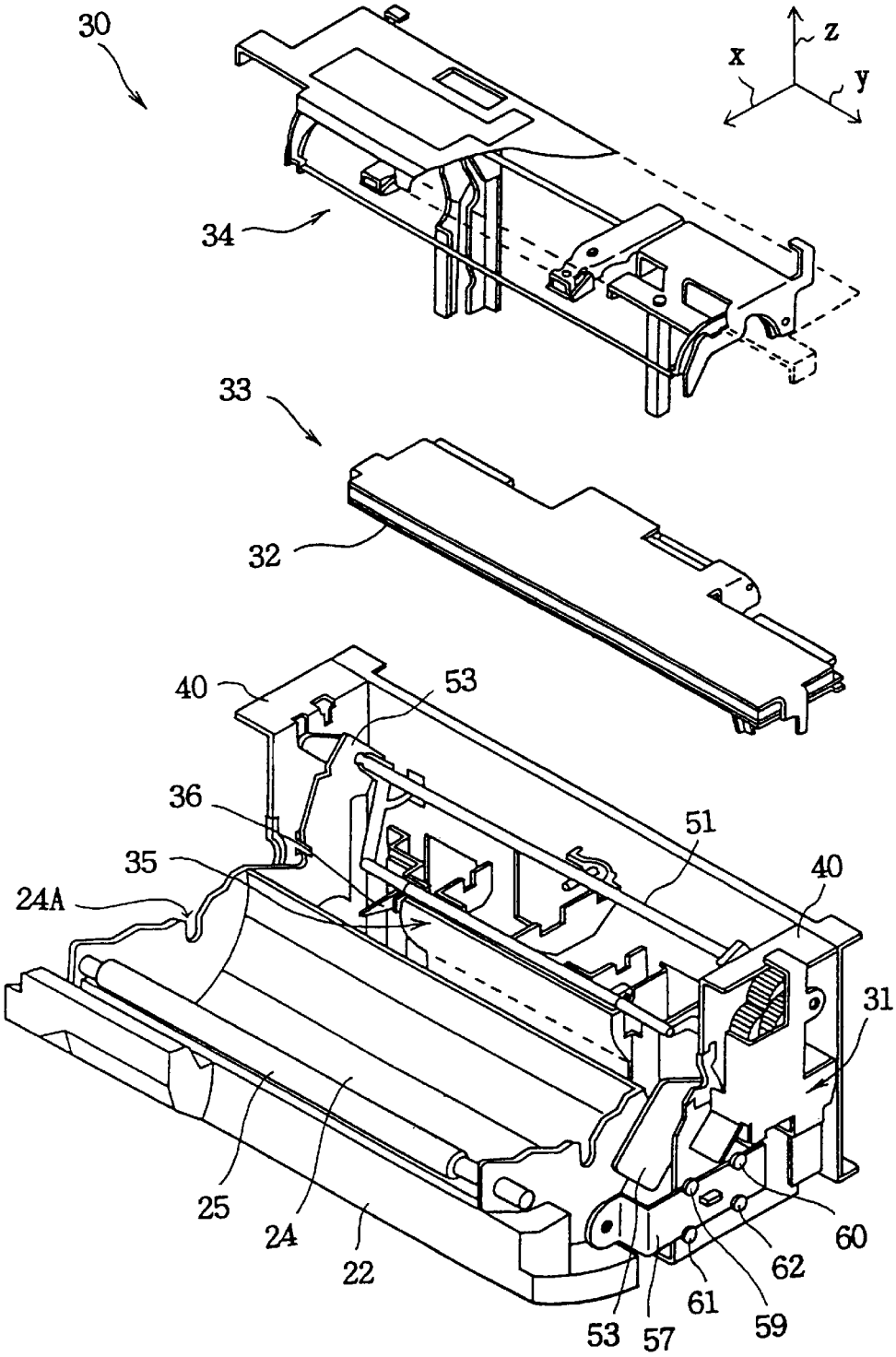
FIG. 7 is an exploded perspective view illustrating the configuration of the mechanical part of the printing apparatus.

Turning next to FIG. 7, illustrating the interior of printing apparatus 3, print film cassette 2 is placed in a predetermined state inside paper tray 24. The print film 9 is pulled out of the print film cassette 2 and its end portion is inserted into the paper discharge port 22A. Door part 22 is then shut so as to load the print film 9, wound in the shape of a roll, into the interior of housing 20. Also within housing 20 is a mechanical part 30 comprising a door open and shut driving mechanical part 31 for opening and shutting the door part 22, a head part 33 to which a line type thermal head 32 is installed at the bottom side, a press mechanical part 34 for pressing the thermal head 32 of the head part 33 onto the platen 7 in printing, a press mechanism driving part 35 for driving the press mechanical part 34, a platen driving part (not shown) for driving the platen 7 to be rotated, and a contact sensor 36 for detecting the existence of the print film 9. During printing, mechanical part 30, under the control of a control part (not shown), positions and presses the head part 33 onto the platen 25 through the print film 9 while initially keeping the head part 33 in the state that it is placed apart from the platen 25 by the press mechanism driving part 35. Additionally, in printing system 1, as illustrated in FIGS. 1, 2, and 5, position fixing projections 15D, 16D are formed from the center of the first or second supporting member 15, 16 toward the diameter direction on the outer side of the first and second supporting members 15, 16 of the print film cassette 2, and cylindrical projections 15E, 16E are formed concentrically with the corresponding first or second supporting member 15, 16 on the position fixing projections 15D, 16D.

Figure 8:
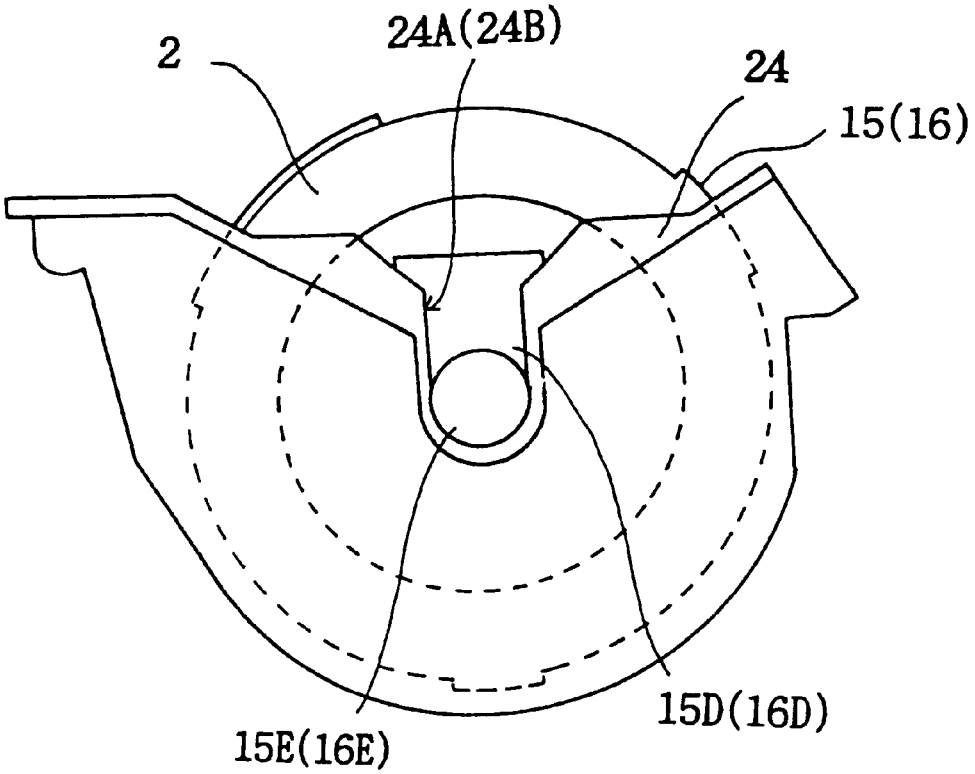
FIG. 8 is a plan view illustrating the print film cassette loaded in a paper tray.

As is apparent from FIG. 1 and FIG. 7, position fixing cutouts 24A, 24B having the same shape as the position fixing projections 15D, 16D are provided on the both sides of the paper tray 24 of the printing apparatus 3 in the width direction such as to correspond to the position fixing projections 15D, 16D of the print film cassette 2. Also in printing system 1, as shown in FIG. 8, the position fixing projections 15D, 16D of the print film cassette 2 are respectively fitted into the corresponding position fixing cutouts 24A, 24B of the printing apparatus 3, so that the print film cassette 2 can be efficiently positioned within printing apparatus 3.

(2) Door Open and Shut Driving Mechanical Part 31 and Contact Sensor 36 of Printing Apparatus 3

Figure 9:
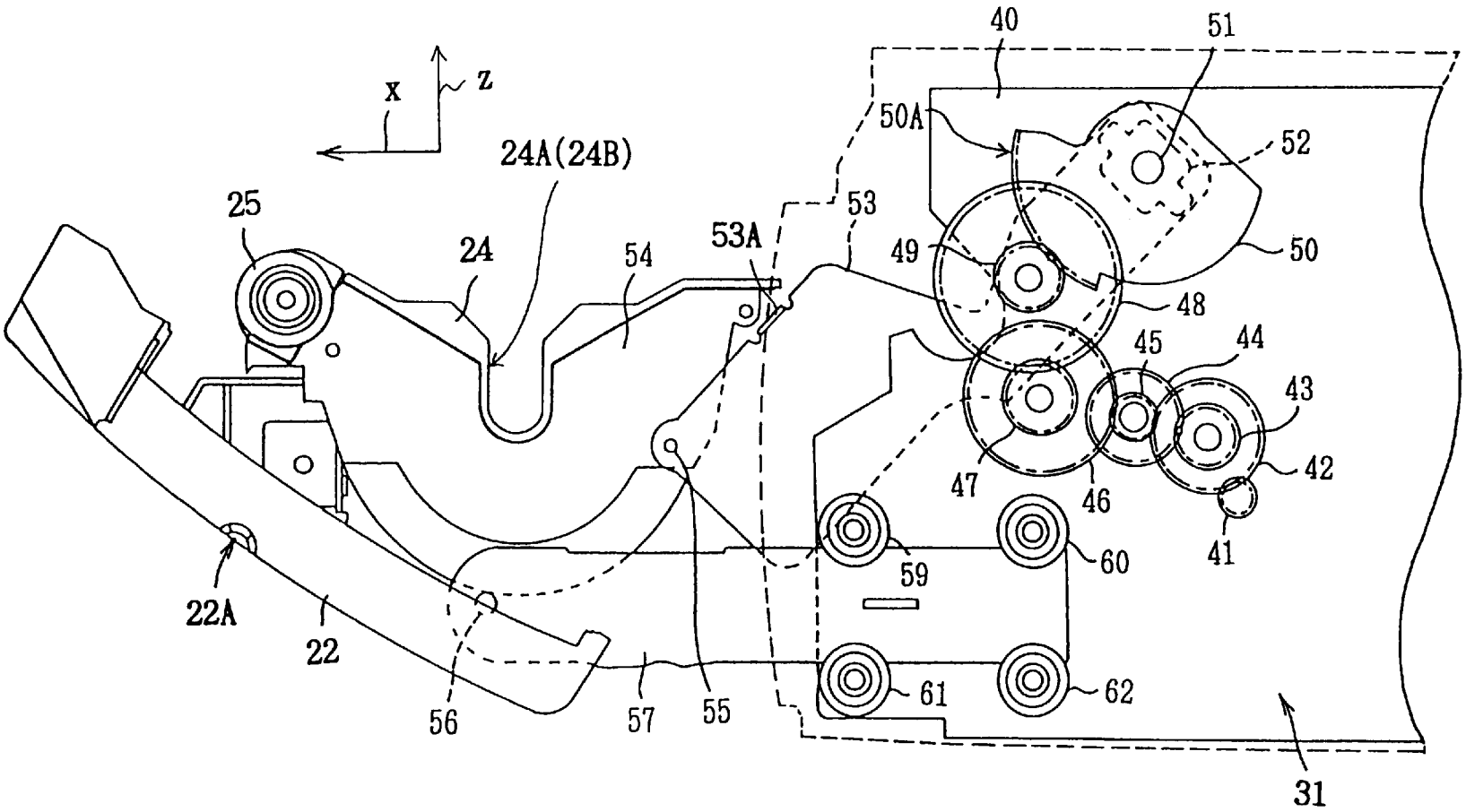
FIG. 9 is a side view explaining a door open and shut driving mechanical part.
Figure 10:
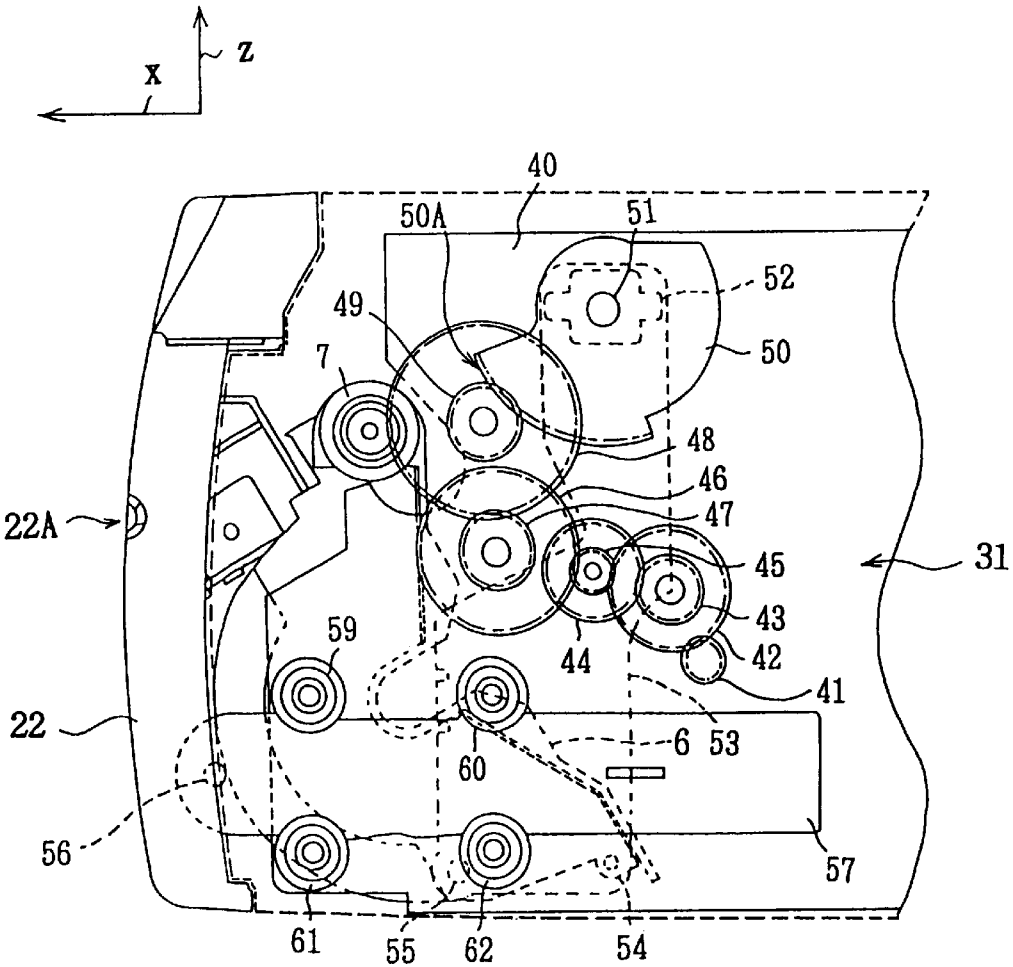
FIG. 10 is a side view explaining a door open and shut driving mechanical part.

As shown in FIG. 9 and FIG. 10, the door open and shut driving mechanical part 31 of the printing apparatus 3 has a motor (not shown) fixed to a side chassis 40. A gear 41 mounted on the output axis of the motor is meshed with a gear part 50A of a shaft driving part 50 through a series of gears comprising first to eighth gears 42 to 49. The shaft driving part 50 is fixed to a shaft 51 which spans rotatively from one side to the other the side chassis 40. An arm receiver 52 is fixed to the shaft 51 through a pin which is not shown. Further, one side of an arm 53 is fixedly attached to the arm receiver 52, and the other side of the arm 53 is rotatively coupled through a pin 55 with the back of an inner chassis 54 to which the paper tray 24 is fixedly attached.

One side of a rail 57 is rotatively mounted on the center part of the side of the inner chassis 54 at the lower stage through the pin 56, and the other side of the rail 57 is supported to be freely slid in the front direction shown by an arrow x and the opposite direction by first to fourth rollers 59 to 62 which are mounted on the side chassis 40. Thus, in the door open and shut driving mechanical part 31, the arm 53 can be rotated together with the shaft driving part 50 with the shaft 51 being centered, based on the rotation power given from the motor to the shaft driving part 51 through a series of gears. On the basis of the rotation power, the portion where the pin 55 of the inner chassis 54 is planted is rotated around the centered shaft 51, and the portion where the pin 56 of the inner chassis 54 is planted is moved together with the rail 57 in a frontward and backward direction, so as to completely open and shut door part 22.

Figure 11:
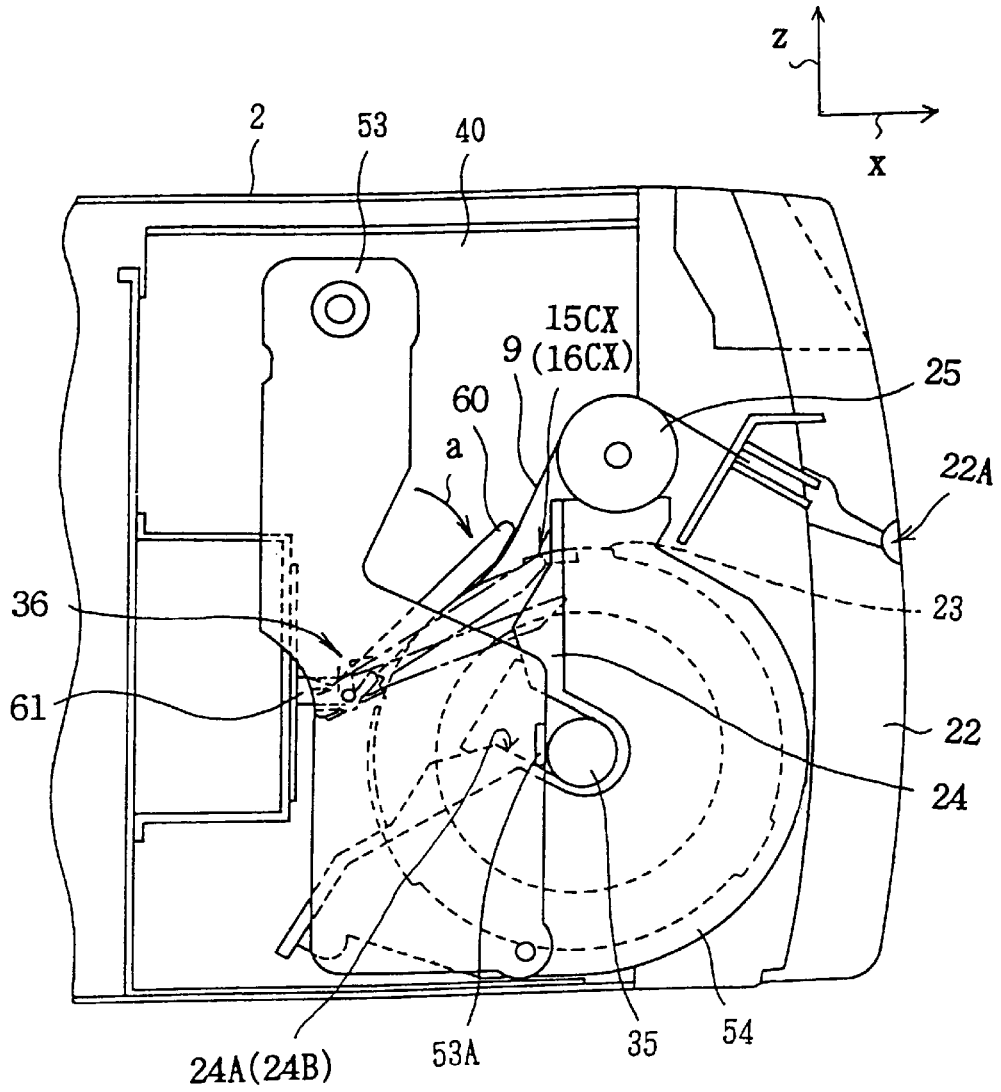
FIG. 11 is a schematically transparent view explaining a contact sensor.

A fixing part 53A comprising a part of the arm 53 being bent vertically is provided at the center of the front side of the arm 53. As shown in FIG. 11, the fixing part 53A is formed such that the position is selected in order to come into contact with the periphery side of the cylindrical projections 15E, 16E formed on the first and second supporting members 15, 16 of the print film cassette 2, under the condition that the door part 22 is shut after the print film cassette 2 is put on the paper tray 24.

If the print film cassette 2 is loaded in the housing 20, the door open and shut driving mechanical part 31 can hold the cylindrical projections 15E, 16E by the fixing part 53A of the arm 53 such as to fix the position fixing projections 15D, 16D of the print film cassette 2 in the corresponding position fixing cutouts 24A, 24B of the paper tray 24, thereby preventing the print film cassette 2 from being lifted or separated from the paper tray 24 during printing.

As shown in FIG. 11, the contact sensor 36 is comprised of a sensor arm 60 rotatively supported with the back portion being centered and a sensor part 61 comprising an interrupter type optical sensor for detecting the rotational position of the back portion of the sensor arm 60. The sensor arm 60 is pressed, at the back portion, toward the upward direction shown by arrow z by elastic materials such as a spring (not shown). Thus, the top portion remains in constant contact with the surface of the print film 9 pulled out of the print film cassette 2 in housing 20.

The sensor arm 60 is also so arranged that the position is selected in order that the top portion comes into contact with the roll core 10 through the cutouts 15CX, 16CX (FIG. 2 and FIG. 11) provided on predetermined pawls 15C, 16C of the first or second supporting member 15, 16 of the print film cassette 2, when the print film 9 of the print film cassette 2 loaded in the housing 20 is exhausted. The sensor part 61 is so arranged that the position is selected in order to detect the back portion of the sensor arm 60, only when the top portion of the sensor arm 60 comes into contact with the roll core 10 of the print film cassette 2. Thus, the printing apparatus 3 can easily confirm the presence of the print film 9 in the print film cassette 2 based on the output of the sensor part 61 of the contact sensor 36.

A fixing part 53A comprising a part of the arm 53 being bent vertically is provided at the center of the front side of the arm 53. As shown in FIG. 11, the fixing part 53A is formed such that the position is selected in order to come into contact with the periphery side of the cylindrical projections 15E, 16E formed on the first and second supporting members 15, 16 of the print film cassette 2, under the condition that the door part 22 is shut after the print film cassette 2 is placed onto paper tray 24.

If the print film cassette 2 is loaded in the housing 20, the door open and shut driving mechanical part 31 can hold the cylindrical projections 15E, 16E by the fixing part 53A of the arm 53 to fix the position fixing projections 15D, 16D of the print film cassette 2 in the corresponding position fixing cutouts 24A, 24B of the paper tray 24, thereby preventing the print film cassette 2 from being lifted or separated from the paper tray 24 during printing.

As shown in FIG. 11, contact sensor 36 is comprised of a sensor arm 60 rotatively supported with the back portion being centered and a sensor part 61 comprising an interrupter type optical sensor for detecting the rotational position of the back portion of the sensor arm 60. The sensor arm 60 is pressed, at the back portion, toward the upward direction shown by arrow z by elastic materials such as a spring (not shown). Thus, the top portion remains in constant contact with the surface of the print film 9 pulled out of the print film cassette 2 in housing 20.

The sensor arm 60 is also arranged such that the position is selected in order that the top portion comes into contact with the roll core 10 through the cutouts 15CX, 16CX (FIG. 2 and FIG. 11) provided on predetermined pawls 15C, 16C of the first or second supporting member 15, 16 of the print film cassette 2, when the print film 9 of the print film cassette 2 loaded in the housing 20 is exhausted. The sensor part 61 is so arranged that the position is selected in order to detect the back portion of the sensor arm 60, only when the top portion of the sensor arm 60 comes into contact with the roll core 10 of the print film cassette 2. Thus, printing apparatus 3 can easily confirm the presence of the print film 9 in the print film cassette 2 based on the output of the sensor part 61 of the contact sensor 36.

(3) Operation and Method of Use of the Embodiments

In the printing system 1 described above, the pawls 15C, 16C of the first and second supporting members 15, 16 forming the holder 12 of the print film cassette 2 prevent the print film 9 from unwinding into a size larger than the outside diameter of the first and second supporting members 15, 16. The print film 9 wound in a roll-shape is thereby easily handled, such that print film 9 can be easily loaded and replaced in the printing apparatus 3, thereby improving replacement ease and efficiency for practical use.

Further, in the printing system 1, the print film cassette 2 is placed in the paper holder 24 such as to put the position fixing projections 15D, 16D of the print film cassette 2 in the corresponding position fixing cutouts 24A, 24B of the paper holder 24 of the printing apparatus 3. Thereafter, the print film 9 is pulled out of the print film cassette 2 and the top portion thereof is inserted into the paper discharge port 22A of the door part 22 through the platen 25. The door part 22 of the printing apparatus 3 is shut to load the print film 9 in the printing apparatus 3.

In the printing system 1, the position of the print film 9 in the paper holder 24 is fixed at the efficient position, so that the sensor arm 60 of the contact sensor 36 can come into stable contact with print film 9, thereby enabling efficient and reliable detection of print film 9.

As shown in FIG. 8, when door part 22 of printing apparatus 3 in printing system 1 is shut, position fixing projections 15D and 16D of the print film cassette 2 are supported such that they are pushed into the corresponding position fixing cutouts 24A, 24B of paper holder 24. Printing system 1 thereby prevents the print film cassette 2 from being lifted or separated from paper holder 24 of the printing apparatus 3, such that the presence of print film 9 can be reliably detected.

According to the above-described structure, a roll-type print film 9 is supported rotatively by the holder 12 having the first and second supporting members 15, 16 for supporting the print film 9, which is to be sandwiched from the both sides in the width direction, and by the pawls 15C, 16C projecting facing each other and being provided on the first and second supporting member 15, 16. The print film 9 is thereby prevented from being unwound, so that the work efficiency in replacement of the print film 9 is improved.

Also, position fixing projections 15D, 16D are respectively provided at a predetermined position of the outer side of the first and second supporting members 15, 16 of the holder 12. The position fixing cutouts 24A, 24B are respectively provided at the both ends of the paper tray 24 of the printing apparatus 3 in the width direction to correspond to the position fixing projections 15D, 16D. The position fixing projections 15D, 16D of the holder 12 are put into the corresponding position fixing cutouts 24A, 24B of the paper tray 24 to load a roll-type print film 9. Thus, the position of the print film 9 in the paper tray 24 is fixed and the sensor arm 60 of the contact sensor 36 can be put into contact with the print film 9.

(4) Other Embodiments

The embodiment described above has addresses the situation where the present invention is applied to a roll-type print media in which print film 9 is wound in the shape of a roll. It should be noted that the present invention is not limited to application or embodiment, but can be widely applied to other roll-type print media as well. Further, the embodiment described above addresses a situation in which holder 12, which rotatively supports the roll-shape print film, comprises the first and second sleeves 13, 14 and the first and second supporting members 15, 16. However, the first and second sleeves 13, 14 may be omitted from holder 12 if print film part 11 is otherwise rotatively supported. Also, while the embodiment described above addresses a situation wherein the means for rotatively supporting the first and second sleeves 13, 14 of the holder 12 of the print film cassette 2 is composed of the first and second supporting members 15, 16, as illustrated in FIGS. 1 to 5, the present invention is not limited to this embodiment, but rather, if the first and second sleeves 13, 14 can be supported rotatively, other various combinations of components may comprise the sleeve supporting means. Further, in the above-described embodiment the first and second sleeves 13, 14 of the print film cassette 2 and the first and second supporting members 15, 16 are formed by using materials having a small friction coefficient such as plastic. However, the present invention is not limited to this structure, but instead, at least the portion including the first and second supporting member 15, 16 of the first and second sleeves 13, 14 and at least the portion including the first and second sleeves 13, 14 of the first and second supporting member 15, 16 may be formed by using any materials having a small friction coefficient, including but not limited to plastics. Further, in the above-described embodiment the sleeve supporting means for rotatively supporting the first and second sleeves 13, 14 of the holder 12 of the print film cassette 2 comprises first and second supporting members 15, 16 formed as illustrated in FIGS. 1 to 5. However, the present invention need not be limited in this manner, but instead, any other structure may provide the means for rotatively supporting the first and second sleeves 13 and 14. Further, the embodiment described above has been dealt with the case where the first and second sleeves 13, 14 of the print film cassette 2 and the first and second supporting members 15, 16 are formed by using materials having a small friction coefficient such as plastics as a whole. However, this invention is not limited to this, but in short, at least the portion involving with the first or second supporting member 15, 16 of the first and second sleeves 13, 14 and at least the portion involving with the first and second sleeves 13, 14 of the first and second supporting member 15, 16 may be formed by using materials having a small friction coefficient such as plastics. The embodiment described above has been further described to include a coupling member for coupling the first and second supporting members 15, 16 of the print film cassette 2, which includes bar type spoke 17 shown in FIGS. 4 and 5. However, the present invention should not be interpreted to be so limited, but rather includes other various shapes and forms compatible for coupling the first and second supporting members 15, 16 integratedly, as will be understood in the art. Further, in the embodiment described above the pawls 15C, 16C are formed on the first and second supporting members 15, 16 of the holder 12 as regulating means for regulating roll-type print film 9 and preventing same from coming unwound. However, the present invention is intended to include other various shapes, forms, and formation for providing this same preventative function. Moreover, the embodiment described above addresses a printing apparatus 3 for printing on the thermal print film 9. However, this invention is intended to function with any printing apparatus that uses a roll-type print media, including apparatuses using print media other than ink and toner. Still further, while the embodiment described above includes print media supporting means for supporting the print film 9 rotatively in the state that the position is fixed in the printing apparatus 3, such means comprising holder 12 of the print film cassette 2 and the position fixing cutouts 24A, 24B in the paper tray 24 of the printing apparatus, any other supporting means known to those skilled in the art will suffice and falls within the scope of the present invention. For example, any mechanism similar to fitting projections 15B, 16B of the first and second supporting members 15, 16 in the holder 12 of the print film cassette 2 may be provided in a side of printing apparatus 3 as the print media supporting means described above, thereby supporting the print film 9 wound around roll core 10 in a fixed position while allowing rotation. Further, while the above-described embodiment addressed the position fixing projections 15D, 16D are provided in the first and second supporting members 15, 16 of print film cassette 2 and the position fixing cutouts 24A, 24B are provided in the paper tray 24 of the printing apparatus as means for fixing the position of the print film 9 in the printing apparatus 3, any appropriate first means for fixing the position may be provided in the print film cassette 2 (or in the print film 9 of the print film cassette 2) and second means provided in the printing apparatus 3 side, such that the first and second involving parts are involved in a predetermined state to fix the position of the print film 9 in the printing apparatus can be widely applied as the forms of the first and second means.

Finally, according to the present invention described above, supporting means for supporting rotatively and regulating means for preventing the roll-type print media from becoming unwound when not desired are provided in the roll-type print media holder, such that the roll-type print media is prevented from being unwound inadvertently and is easily handled. Furthermore, according to the present invention, print media supporting means for supporting the roll-type print media rotatively in the state that the position is fixed and a sensor for detecting the presence of the roll-type print media are provided in the printing apparatus, in a manner such that the contact sensor can be in constant contact with the roll-type print media.

Although the present invention has been shown and described with respect to preferred embodiments, various changes and modifications lie within the spirit and scope of the claimed invention. Thus, the corresponding structures, materials, acts, and equivalents of all means or step plus function elements in the claims are intended to include any structure, material, or acts for performing the functions in combination with other elements as specifically claimed.

What is claimed is:

1. An open non-cassette type holder for roll-type print media, comprising:

supporting means for rotatively supporting a roll-type print media; and regulating means for regulating unwinding of said roll-type print media, wherein:

said roll-type print media comprises said print media wound around a cylindrical member;

said supporting means comprises first and second supporting means for supporting said roll-type print media rotatively at either side of said roll-type print media, and coupling means for coupling said first and second supporting members; and said regulating means comprises pawls, located at least three predetermined positions in said first and second supporting members, such that the pawls of said first supporting member face the pawls of said second supporting member, each of said pawls securing said print media at a maximum diameter of said first and second supporting means, and an anti-unwind portion of said pawls, facing said print media, maintains a constant distance from said cylindrical member.

2. The holder for roll-type print media according to claim 1, wherein said roll-type print media comprise print media wound around a cylindrical member; and said supporting means comprises:

first and second sleeves respectively attached to either end of said cylindrical member; and sleeve supporting means, integral with said first and second sleeves, for rotatively supporting the first and second sleeves.

3. The holder for roll-type print media according to claim 2, wherein said first and second sleeves and sleeve supporting means are formed using materials having low friction coefficients.

4. The holder for roll-type print media according to claim 1, further comprising:

a spoke connecting at least two of said pawls located at opposite ends of said holder; and a dust pad attached to said spoke and abutting the surface of said roll-type print media.

5. A roll-type print media cassette, comprising:

a quantity of print media wound in the shape of a roll;

supporting means for rotatively supporting said roll-type print media; and regulating means for regulating the unwinding of said roll-type print media, wherein:

said print media is wound around a cylindrical member and said supporting means comprises, first and second supporting means for supporting said roll-type print media rotatively at either side of said roll-type print media, and coupling means for coupling said first and second supporting members;

said regulating means comprises pawls formed at at least three predetermined positions around the diameter of each of said first and second supporting members and positioned to face each other across said media;

each of said pawls securing said print media at a maximum diameter of said first and second supporting means; and an anti-unwind portion of said pawls, facing said print media, maintains a constant distance from said cylindrical member.

6. The roll-type print media cassette according to claim 5, wherein said print media is wound around a cylindrical member and said supporting means comprises:

first and second sleeves attached to either side of said cylindrical member; and sleeve supporting means, in contact with said first and second sleeves, for rotatively supporting the first and second sleeves.

7. The roll-type print media cassette according to claim 6, wherein said first and second sleeves and said sleeve supporting means, at least a portion of which are in contact with one another, are formed from materials having low coefficients of friction.

8. The roll-type print media cassette according to claim 5, further comprising a dust pad abutted to the surface of said roll-type print media.

9. The roll-type print media cassette according to claim 5, wherein:

said cassette further comprises, a spoke attached to two of said pawls at opposite ends of said cassette, and a dust pad attached to said spoke and directed toward a surface of said media.

10. A printing apparatus which uses a roll-type print media wound in the shape of a roll, comprising:

print media supporting means for rotatively supporting said roll-type print media in a stable position;

a contact sensor for detecting the presence or absence of said roll-type print media;

a door part which can be opened and shut freely;

a tray, positioned internal to said door part, for loading said roll-type print media;

door part open and shut driving means, having an an arm coupled with said door part, for driving said door part to be opened and shut by moving said arm; and fixing means, connected to said arm, for engaging at least a portion of said roll-type print media with at least a portion of said supporting means when said door part is in a closed position.

11. The printing apparatus according to claim 10, wherein said print media supporting means supports said roll-type print media such that the position is fixed at either side of said roll-type print media.

* * * * *